US006945632B2

(12) United States Patent
Nakamura et al.

(10) Patent No.: US 6,945,632 B2
(45) Date of Patent: Sep. 20, 2005

(54) INK JET HEAD AND INK JET TYPE RECORDING APPARATUS

(75) Inventors: Tetsuroh Nakamura, Hyogo (JP); Hiroyuki Matsuo, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 102 days.

(21) Appl. No.: 10/019,358

(22) PCT Filed: Mar. 23, 2001

(86) PCT No.: PCT/JP01/01395

§ 371 (c)(1),
(2), (4) Date: Oct. 24, 2001

(87) PCT Pub. No.: WO01/62499

PCT Pub. Date: Aug. 30, 2001

(65) Prior Publication Data

US 2003/0020787 A1 Jan. 30, 2003

(30) Foreign Application Priority Data

Feb. 25, 2000 (JP) ..... 2000-048619
Feb. 25, 2000 (JP) ..... 2000-048630

(51) Int. Cl.[7] ..... B41J 2/05

(52) U.S. Cl. ..... 347/58; 347/68; 347/70

(58) Field of Search ..... 347/68, 70–72, 347/50, 59, 58, 49, 57, 40

(56) References Cited

U.S. PATENT DOCUMENTS 6,270,193 B1 * 8/2001 Hiwada ..... 347/50

FOREIGN PATENT DOCUMENTS

| | | | |
|---|---|---|---|
| JP | 11-78013 | 3/1999 | |
| JP | 11-179903 | 7/1999 | |
| JP | 2000-79683 | * 3/2000 | ..... B41J/2/045 |

* cited by examiner

*Primary Examiner*—Hai Pham
*Assistant Examiner*—Lam Nguyen
(74) *Attorney, Agent, or Firm*—Harness, Dickey & Pierce, P.L.C.

(57) ABSTRACT

An ink jet head includes a head body (11) which is provided with a plurality of nozzles and a plurality of pressure chambers and actuators (14) respectively corresponding to the nozzles. Input terminals (37) of the actuators (14) are arranged locally between left-side and right-side central actuator columns (14A, 14A). A driver IC (13) is mounted on the head body (11) by flip chip bonding.

5 Claims, 14 Drawing Sheets

INK JET HEAD AND INK JET TYPE RECORDING APPARATUS

TECHNICAL FIELD

The present invention relates to an ink jet head and an ink jet type recording apparatus incorporating the same.

BACKGROUND ART

Ink jet heads for recording information by utilizing a piezoelectric effect of piezoelectric elements have been known in the prior art, as disclosed in, for example, Japanese Laid-Open Patent Publication No. 5-18735. An ink jet head of this type is provided with actuators having piezoelectric elements, and is configured to discharge ink through nozzles by the action of the actuators.

Typically, a plurality of pressure chambers to which ink is supplied and a common ink chamber communicated to the pressure chambers are formed separately from each other in a head body. A plurality of nozzles respectively corresponding to the pressure chambers are formed on the reverse side surface of the head body. On the other hand, a vibration plate, a common electrode, a piezoelectric element and a separate electrode are deposited in this order on the front side surface of the head body, and the vibration plate, the common electrode, the piezoelectric element and the separate electrode together form an actuator for discharging ink through a nozzle by applying a pressure on the pressure chamber.

In order to drive the actuator, there is needed a driver IC, separately from the head body, for outputting a driving signal to the actuator. When the driver IC is provided on the printer body, it is necessary to extend the same number of driving signal lines as the number of nozzles from the printer body to the head body by using an FPC, or the like. Thus, there was a problem that the total length of the driving signal lines increases.

In view of this, as a technique for shortening the driving signal lines, there has been proposed a technique of providing the driver IC near the side surface of the head body (the surface perpendicular to the surface along which nozzles are arranged), and providing the same number of driving signal lines as the number of nozzles from the driver IC near the head body to the head body via an FPC, or the like. Moreover, in the ink jet head disclosed in Japanese Laid-Open Patent Publication No. 5-18735, supra, a driver IC 121 is mounted on a vibration plate 103 of a head body 100 as illustrated in FIG. 19, so that the only signal lines between the printer body and the head body are the signal lines for IC driving. Specifically, the driver IC 121 is mounted in parallel beside piezoelectric elements 102 and a common electrode 104. Note that in FIG. 19, 122 is a line pattern for connecting the driver IC 121 and separate electrodes to each other.

However, with the way of mounting disclosed in the above-identified publication, the driver IC 121 is simply directly mounted on the vibration plate 103 with no special modification. Therefore, it was necessary to arrange the driver IC 121 in parallel to and remotely from the piezoelectric element 102 so as to avoid the area of the vibration plate 103 where it actually vibrates (the area where the actuators 102 are provided). Stated conversely, it was necessary to ensure an additional space on the surface of the head body for mounting the driver IC 121. Moreover, since the driver IC 121 is provided remotely from the actuators 102 as described above, it was necessary to extend the lines 122 from the actuators 102 to the driver IC 121, thereby inevitably increasing the length of the lines 122. Therefore, the surface area of the head body 100 increased, and it was unavoidable for the ink jet head as a whole to be large in size. Note that such a problem similarly occurs in other arrangements where the driver IC is provided near a side surface of the head body.

Moreover, in the conventional head, driver IC 121 was made of a semiconductor material such as silicon, whereas the head body was made of a resin material, or the like. In such a case, the coefficient of linear expansion of the material of the driver IC and that of the material of the head body are substantially different from each other. For example, while the coefficient of linear expansion of silicon is $2.5\times10^{-6}$[1/° C.], the coefficient of linear expansion of a resin material is larger than this by one order of magnitude or more. Therefore, in a case where the driver IC is mounted on the head body by flip chip bonding, wherein solder bumps, or the like, between terminals are melted by heating, contact failure between terminals was likely to occur due to the difference therebetween in the degree of thermal expansion. Moreover, even if a desirable connection was obtained when heated, thermal contraction occurred along with the subsequent decrease in temperature, resulting in peeling off of the terminals in some cases.

Particularly, the density of the head has recently been increased, whereby the interval between actuator terminals is becoming shorter and shorter. Thus, even a slight difference in the degree of thermal expansion and thermal contraction between the driver IC and the head body may lead to contact failure between terminals, thereby extremely reducing the yield of the product.

Moreover, the following problem exists which is characteristic of piezo type ink jet heads. That is, a piezo type ink jet head discharges ink by flexural deformation of actuators. Therefore, as the rigidity of the actuators changes, the ink discharging performance (e.g., the ink discharge velocity, the discharge amount, the driving frequency, etc.) changes. When the degree of thermal deformation of the driver IC differs from that of the head body, the head body (particularly, the actuators) undergoes a residual stress, i.e., a tensile shear force or a compression shear force, from the driver IC, whereby the rigidity of the actuators changes. Specifically, when an actuator undergoes a tensile shear force, the rigidity thereof increases and it becomes less flexible, whereas when it undergoes a compression shear force, the rigidity thereof decreases and it becomes more flexible. Thus, there was a problem that when the coefficient of linear expansion of the driver IC is substantially different from that of the head body, the rigidity of the actuators changes, thereby making the ink discharging performance instable.

Moreover, a difference in coefficient of linear expansion between the driver IC and the head body might possibly cause warping of the head body. As a result, the striking positions of ink droplets discharged from nozzles at both ends of the head body might possibly be shifted from the intended positions.

The present invention has been made in view of the above, and has an object to facilitate downsizing of an ink jet head.

Another object is to prevent contact failure between terminals and deterioration of the discharging performance due to thermal expansion and thermal contraction, thereby improving the reliability and the yield of a head.

DISCLOSURE OF THE INVENTION

According to one aspect of the present invention, a driver IC is mounted on a head body by face down bonding with a modification to the arrangement of signal input terminals of actuators.

According to another aspect of the present invention, at least a driver IC side portion of the head body is made of a material whose coefficient of linear expansion is the same, or substantially the same, as that of the driver IC.

According to a first aspect of the present invention, there is provided an ink jet head, including a head body which is provided with a plurality of nozzles and a plurality of pressure chambers and actuators respectively corresponding to the nozzles, and a driver IC for outputting driving signals for driving the actuators, wherein: the actuators are arranged on a surface of the head body in a plurality of columns so as to form a plurality of actuator columns; signal input terminals of the actuators are arranged locally in a predetermined area between the actuator columns; the driver IC is provided with signal output terminals arranged so as to respectively correspond to the signal input terminals of the actuators; and the driver IC is mounted on the head body by face down bonding so that the signal output terminals and the signal input terminals are connected to each other.

Thus, since the driver IC is mounted on the head body by face down bonding, with the driver IC facing the head body, it is not necessary to provide a space on the head body for mounting the driver IC, thereby downsizing the head. Moreover, since the signal input terminals of the, actuators are arranged locally between actuator columns, the signal lines are shortened and the head is downsized, unlike in the prior art where the signal input terminals are provided remotely from the actuators. Moreover, since the signal output terminals of the driver IC are locally arranged so as to respectively correspond to the signal input terminals of the actuators, mounting by face down bonding is facilitated.

A second aspect of the present invention is the first aspect of the present invention, wherein: each of the actuator columns extends in a direction perpendicular to a scanning direction; and the signal input terminals of the actuators are arranged in a direction perpendicular to the scanning direction on the surface of the head body in a central portion thereof with respect to the scanning direction.

Thus, since the signal input terminals are arranged in the central portion of the head body with respect to the scanning direction, the distance between the signal input terminals to the actuators is shortened, thereby downsizing the head.

A third aspect of the present invention is the second aspect of the present invention, wherein: the actuator columns include a first central actuator column and a second central actuator column adjacent to each other in a central portion of the head body with respect to the scanning direction, and one or more outer actuator column provided on an outer side of the central actuator columns with respect to the scanning direction; the signal input terminals of the actuators are arranged between the first central actuator column and the second central actuator column; and the actuators of each outer actuator column and the signal input terminals thereof are connected to each other by signal lines passing between actuators of one of the central actuator columns.

Thus, a signal line extending from each actuator of the outer actuator column passes between actuators of one central actuator column so as to be connected to one of the signal input terminals provided in the central portion of the body part with respect to the scanning direction. Therefore, each space between actuators is efficiently used as a space for providing a signal line, thereby facilitating downsizing of the head.

A fourth aspect of the present invention is the third aspect of the present invention, wherein the actuators of each actuator column are arranged at regular intervals so as to be shifted from the actuators of any other actuator column in a direction perpendicular to the scanning direction.

Thus, since actuators of different actuator columns are shifted from each other in a direction perpendicular to the scanning direction (hereinafter referred to as the "perpendicular direction"), the actuators (as well as the nozzles and the pressure chambers) are arranged at intervals narrower than the actuator interval of each actuator column. This facilitates an increase in the actuator density, and also facilitates downsizing of the head and an increase in the ink dot density.

According to a fifth aspect of the present invention, there is provided an ink jet head, including a head body which is provided with a plurality of nozzles and a plurality of pressure chambers and actuators respectively corresponding to the nozzles, and a driver IC for outputting driving signals for driving the actuators, wherein: the actuators are arranged on a surface of the head body; a signal input terminal of each actuator is provided on the surface of the head body near the actuator; the driver IC is provided with signal output terminals provided so as to respectively correspond to the signal input terminals of the actuators; and the driver IC is mounted on the head body by face down bonding so that the signal output terminals and the signal input terminals are connected to each other.

Thus, since the driver IC is mounted on the head body by face down bonding, with the driver IC facing the head body, it is not necessary to provide a space on the head body for mounting the driver IC, thereby downsizing the head. Moreover, since the signal input terminal of each actuator is provided near the actuator, it is possible to shorten the signal line for connecting the actuator and the signal input terminal to each other. Moreover, by arranging each signal input terminal near an actuator so as to be continuous with the actuator, it is possible to eliminate the signal line. Therefore, the space for arranging the signal lines is reduced or eliminated, thereby downsizing the head.

A sixth aspect of the present invention is the fifth aspect of the present invention, wherein: the actuators form a plurality of actuator columns each including a plurality of actuators arranged at regular intervals in a direction perpendicular to the scanning direction; and the actuators of each actuator column are arranged so as to be shifted from the actuators of any other actuator column in the direction perpendicular to the scanning direction.

Thus, an increase in the density of the actuators (as well as the nozzles and the pressure chambers) is facilitated, thereby downsizing the head and increasing the ink dot density.

A seventh aspect of the present invention is the fourth or sixth aspect of the present invention, wherein the actuators are arranged in a staggered pattern.

Thus, an increase in the density of the head is further facilitated.

According to an eighth aspect of the present invention, there is provided an ink jet head, including a head body which is provided with a plurality of nozzles and a plurality of pressure chambers and actuators respectively corresponding to the nozzles, and a driver IC for outputting driving signals for driving the actuators, wherein: the driver IC is attached to the head body; and at least a driver IC side portion of the head body is made of the same material as the driver IC.

According to a ninth aspect of the present invention, there is provided an ink jet head, including a head body which is provided with a plurality of nozzles and a plurality of pressure chambers and actuators respectively corresponding to the nozzles, and a driver IC for outputting driving signals for driving the actuators, wherein: the driver IC is mounted on the head body by flip chip bonding; and at least a driver IC side portion of the head body is made of the same material as the driver IC.

Thus, since the driver IC side portion of the head body and the driver IC are made of the same material, the amount of thermal deformation (thermal expansion or thermal contraction) will be about the same. Therefore, there is no relative displacement (positional shift) therebetween, and a desirable contact between the signal output terminals of the driver IC and the signal input terminals of the head body is maintained. Moreover, since the head body does not undergo an extra stress from the driver IC, the discharging performance of the head does not deteriorate.

A tenth aspect of the present invention is the ninth aspect of the present invention, wherein: the head body includes a body part provided with a plurality of nozzles and a plurality of pressure chamber depressions respectively corresponding to the nozzles; each actuator includes a vibration plate provided on a surface of the body part so as to cover the pressure chamber depressions to define pressure chambers, piezoelectric elements individually provided on the surface of the vibration plate so as to respectively correspond to the pressure chambers, and separate electrodes provided on one side of the piezoelectric elements; signal input terminals to be connected to signal output terminals of the driver IC are respectively connected to the separate electrodes of the actuators; and at least a front side portion of the body part is made of the same material as the driver IC.

Thus, the amount of thermal deformation of the driver IC is about the same as that of the front side portion of the body part. Since the vibration plate is thinner than the body part, the amount of displacement of the signal input terminals will substantially depend on the amount of thermal deformation of the body part. Therefore, the relative displacement between the signal output terminals of the driver IC and the signal input terminals of the actuators will consequently be small, thereby maintaining a good contact between the terminals.

An eleventh aspect of the present invention is the ninth aspect of the present invention, wherein: the head body includes a body part provided with a plurality of nozzles and a plurality of pressure chamber depressions respectively corresponding to the nozzles; each actuator includes a vibration plate provided on a surface of the body part so as to cover the pressure chamber depressions to define pressure chambers, and piezoelectric elements individually provided on the surface of the vibration plate so as to respectively correspond to the pressure chambers, each piezoelectric element being sandwiched between a common electrode and a separate electrode; signal input terminals for connecting the separate electrodes of the actuators respectively to signal output terminals of the driver IC are provided on the surface of the vibration plate; and the vibration plate is made of the same material as the driver IC.

Thus, the signal input terminals are provided on the surface of the vibration plate which is made of the same material as the driver IC, and the amount of thermal deformation of the driver IC is the same as that of the vibration plate, whereby the amount of displacement of the signal input terminals will be equal to that of the signal output terminals. Therefore, there is no positional shift between the signal input terminals and the signal output terminals, thereby maintaining a desirable contact therebetween.

A twelfth aspect of the present invention is the tenth or eleventh aspect of the present invention, wherein an entirety of the body part is made of the same material as the driver IC.

Thus, since the entirety of the body part thermally expands or thermally contracts to about the same degree as does the driver IC, the contact between the signal output terminals and the signal input terminals is maintained at a high level.

A thirteen aspect of the present invention is the eighth or ninth aspect of the present invention, wherein the driver IC is made of silicon.

Thus, using silicon, which is easy to process, makes the production of the driver IC easier.

According to a fourteenth aspect of the present invention, there is provided an ink jet head, including a head body which is provided with a plurality of nozzles and a plurality of pressure chambers and actuators respectively corresponding to the nozzles, and a driver IC for outputting driving signals for driving the actuators, wherein: the driver IC is attached to the head body; and at least a driver IC side portion of the head body is made of a material whose coefficient of linear expansion is substantially equal to that of the driver IC.

According to a fifteenth aspect of the present invention, there is provided an ink jet head, including a head body which is provided with a plurality of nozzles and a plurality of pressure chambers and actuators respectively corresponding to the nozzles, and a driver IC for outputting driving signals for driving the actuators, wherein: the driver IC is mounted on the head body by flip chip bonding so that signal input terminals of the actuators and signal output terminals of the driver IC are connected to each other; and at least a driver IC side portion of the head body is made of a material whose coefficient of linear expansion is substantially equal to that of the driver IC.

Thus, the amount of thermal deformation of the driver IC side portion of the head body will be about the same as that of the driver IC. Therefore, the amount of relative displacement therebetween becomes very small, thereby maintaining a desirable contact between the signal output terminals of the driver IC and the signal input terminals of the head body. Moreover, deterioration of the ink discharging performance of the head is suppressed.

A sixteenth aspect of the present invention is any one of the eighth, ninth, fourteenth and fifteenth aspects of the present invention, wherein signal input terminals are arranged locally in a predetermined area.

Thus, when the signal input terminals are locally arranged, the influence of the positional shift between the signal input terminals and the signal output terminals of the driver IC due to thermal expansion or thermal contraction is likely to be significant. Accordingly, the effect of maintaining a good contact between terminals and the effect of suppressing deterioration of the ink discharging performance as described above will be pronounced.

A seventeenth aspect of the present invention is the sixteenth aspect of the present invention, wherein: a plurality of actuator columns are formed, each including a plurality of actuators arranged in a direction perpendicular to a scanning direction; the actuators of each actuator column are arranged so as to be shifted from the actuators of any other actuator column in the direction perpendicular to the scanning direction; and the signal input terminals of the actuators are arranged in the direction perpendicular to the scanning direction between the actuator columns in a central portion of a body part with respect to the scanning direction.

Thus, since the signal input terminals are provided between the actuator columns in the central portion of the body part with respect to the scanning direction, the head is downsized over conventional heads where the signal input terminals are provided on the outer side of the actuator columns. In such a configuration where the signal input terminals of the actuators are arranged in the perpendicular direction, which is perpendicular to the scanning direction, the influence of thermal expansion or thermal contraction in the perpendicular direction is usually substantial, whereby the contact between the signal input terminals and the signal output terminals is likely to deteriorate. Thus, the effect of maintaining a desirable contact between terminals as described above is pronounced. Moreover, the effect of suppressing deterioration of the ink discharging performance will also be pronounced.

An eighteenth aspect of the present invention is the ninth or fifteenth aspect of the present invention, wherein a signal input terminal of each actuator is provided near the actuator.

Thus, the signal lines for connecting the signal input terminals and the actuators to each other can be shortened. Moreover, by providing each signal input terminal near an actuator so as to be continuous with the separate electrode of the actuator, it is possible to eliminate the signal line. Therefore, the space for arranging the signal lines is reduced or eliminated, thereby downsizing the head. Since it is even more concerned in such a high-density configuration that contact failure between the signal input terminals and the signal output terminals might occur due to thermal expansion or thermal contraction, the effect of maintaining a desirable contact between terminals will be pronounced. Moreover, the effect of suppressing deterioration of the ink discharging performance will also be pronounced.

A nineteenth aspect of the present invention is the fourteenth or fifteenth aspect of the present invention, wherein a difference between a coefficient of linear expansion of at least a driver IC side portion of the head body and that of the driver IC is $123\times10^{-7}$[1/° C.] or less.

Thus, contact failure between terminals is prevented, and deterioration of the ink discharging performance is also prevented.

A twentieth aspect of the present invention is the fourteenth or fifteenth aspect of the present invention, wherein: the head body is formed in a thin-plate-like generally rectangular solid shape; the actuators are provided on a surface of the head body; the driver IC is attached to a portion of the surface of the head body in a longitudinal direction of the head body; and a front surface side of the head body undergoes a compression shear force due to thermal deformation from the driver IC, thereby bending the head body into a concave shape.

Thus, the rigidity of the actuators is prevented from being excessive due to a residual stress caused by a thermal distortion, and discharge failure, at least those that make it difficult to form a solid image, is prevented.

A twenty-first aspect of the present invention is any one of the eighth, ninth, fourteenth and fifteenth aspect of the present invention, wherein the ink jet head is a line type head.

Since a line type head is very long in the longitudinal direction, contact failure between terminals and deterioration of the discharging performance are likely to occur due to even a slight difference between the amount of thermal deformation of the head body and that of the driver IC. Therefore, the effect of maintaining a desirable contact and the effect of stabilizing the ink discharging performance of the present invention are pronounced.

According to a twenty-second aspect of the present invention, there is provided an ink jet type recording apparatus, including: the ink jet head of any one of the first to twenty-first aspects of the present invention; and movement means for relatively moving the ink jet head and a recording medium with respect to each other.

As described above, according to the present invention, the signal input terminals of the actuators are arranged locally between the actuator columns, or near the respective actuators, and the driver IC is mounted on the head body by face down bonding. Therefore, it is not necessary to provide a space for mounting the driver IC, a space for providing the signal input terminals, and a space for providing signal lines for connecting the actuators and the signal input terminals to each other, in an area remote from the actuators, whereby it is possible to downsize the head and to increase the dot density.

Moreover, according to the present invention, at least the driver IC side portion of the head body is made of the same material as the driver IC, or a material whose coefficient of linear expansion is substantially equal to that of the driver IC, whereby when the driver IC is mounted on the head body, the amount of displacement due to thermal deformation can be made substantially equal between the signal input terminals and the signal output terminals, and it is thus possible to prevent the signal input terminals and the signal output terminals from being positionally shifted from each other. Therefore, it is possible to maintain a desirable contact between the signal input terminals and the signal output terminals even if the density of the head increases, thereby improving the reliability and the yield. Moreover, it is possible to suppress deterioration of the ink discharging performance due to thermal deformation.

BEST MODE FOR CARRYING OUT THE INVENTION

Embodiments of the present invention will now be described with reference to the drawings.

<Embodiment 1>

Configuration of Ink Jet Printer

Figure 1:
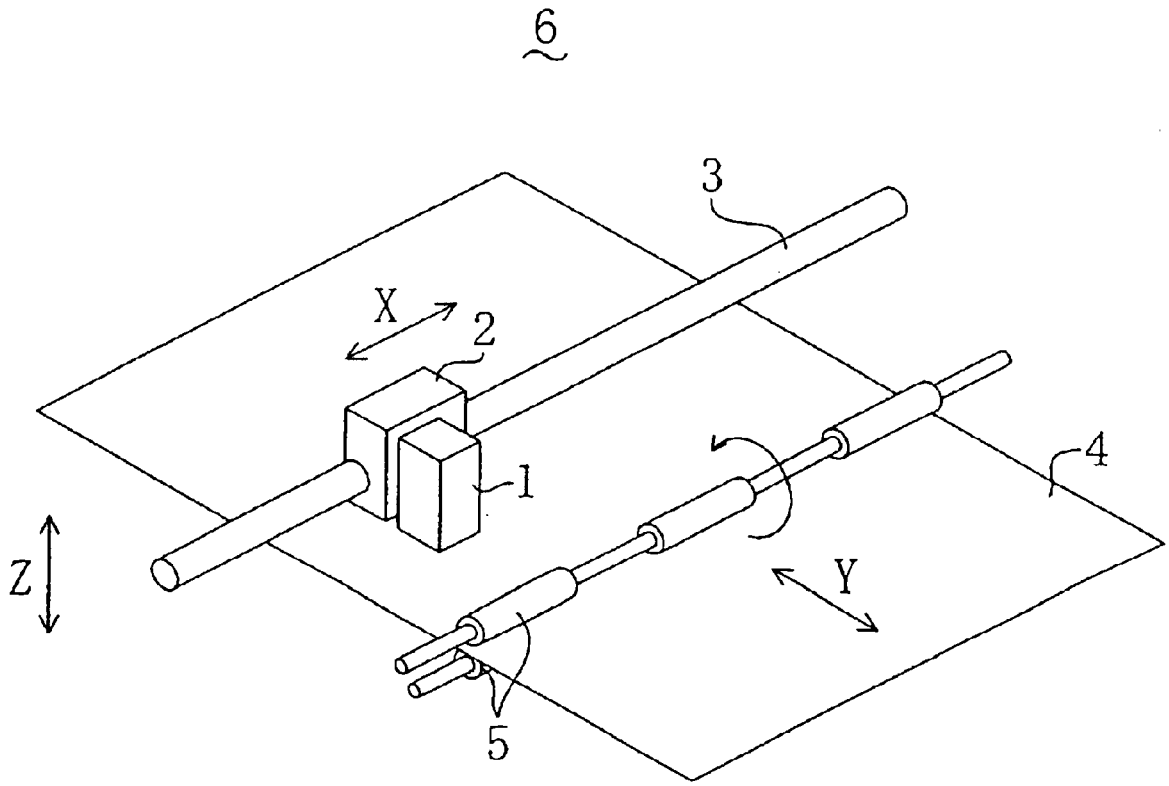
FIG. 1 is a perspective view illustrating an important part of an ink jet printer.

As illustrated in FIG. 1, an ink jet printer 6 is a recording apparatus, including an ink jet head 1 for recording information by utilizing a piezoelectric effect of piezoelectric elements, in which information is recorded by discharging ink droplets from the ink jet head 1 so as to strike a recording medium 4 such as paper. The ink jet head 1 is mounted on a carriage 2, which is reciprocated along a carriage shaft 3, so as to be reciprocated in the primary scanning direction X parallel to the carriage shaft 3. The recording medium 4 is appropriately carried by rollers 5 in the secondary scanning direction Y.

Configuration of Ink Jet Head

Figure 2:
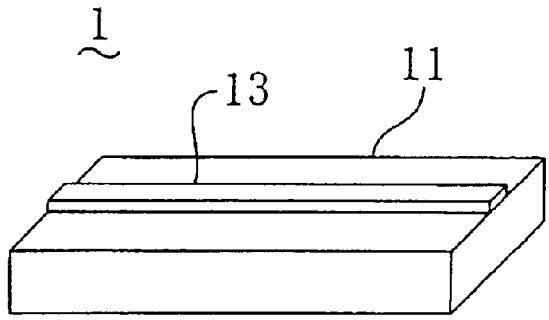
FIG. 2 is a perspective view illustrating an ink jet head.
Figure 3:
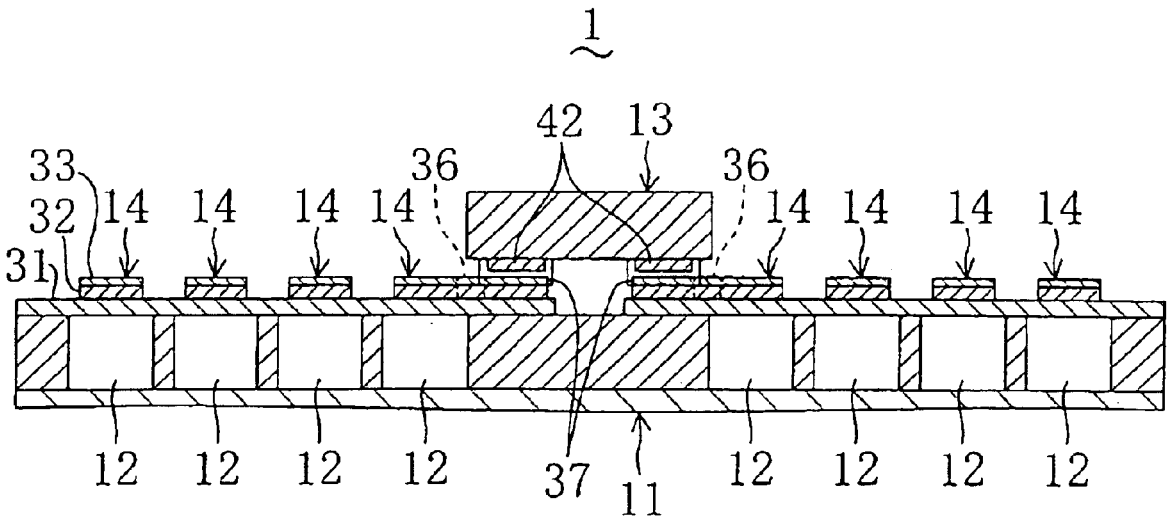
FIG. 3 is a cross-sectional view (taken along line A—A of FIG. 10) illustrating an ink jet head.

As illustrated in FIG. 2 and FIG. 3, the ink jet head 1 of Embodiment 1 includes a head body 11 and a driver IC 13. A plurality of nozzles 23 (see FIG. 5) for discharging ink and a plurality of pressure chambers 12 and actuators 14 arranged so as to respectively correspond to the nozzles 23 are formed in the head body 11. The driver IC 13 is made of a silicon (Si), which is a semiconductor material, and the driver IC 13 is provided with a driving circuit (not shown) for supplying a driving signal to the actuators 14. The driver IC 13 is mounted on the head body 11 by flip chip bonding.

As illustrated in FIG. 2, the head body 11 is formed in a thin-plate-like generally rectangular solid shape having a length of 20 mm, a width of 10 mm and a thickness of about 0.9 mm. On the other hand, the driver IC 13 has a shape elongated in one direction. Specifically, it is formed in a rectangular solid shape having a length of 20 mm, a width of 2 mm and a thickness of 0.4 mm.

Figure 4:
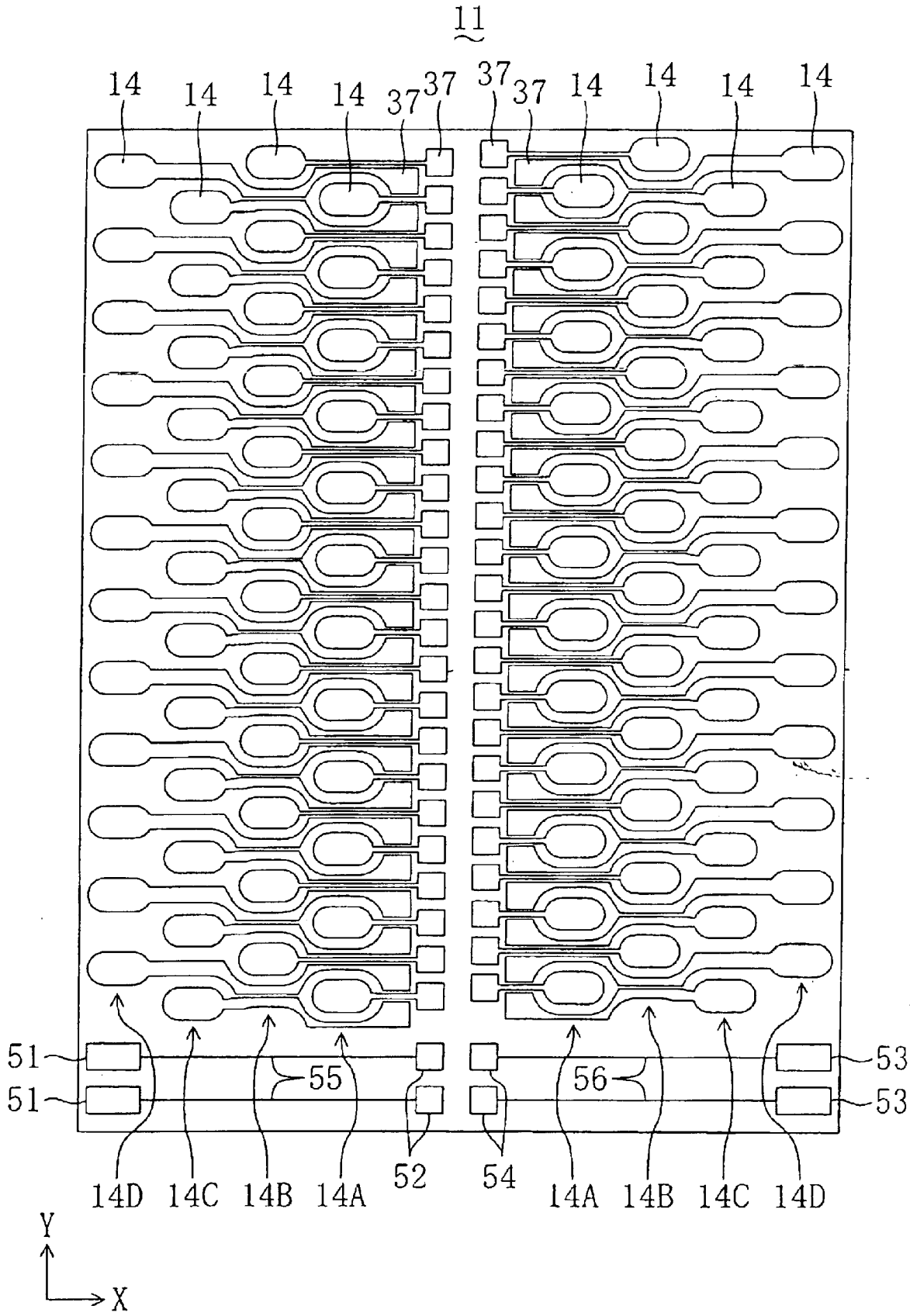
FIG. 4 is a diagram illustrating the surface of a head body of an ink jet head.

As illustrated in FIG. 4, on the surface of the head body 11, 8 actuators 14 are arrayed in the primary scanning direction X so as to form 8 actuator columns 14A to 14D and 14A to 14D each extending in the secondary scanning direction Y. The 8 actuator columns include 4 right-side actuator columns 14A to 14D and 4 left-side actuator columns 14A to 14D. Note that only 12 actuators are shown for each actuator column for ease of understanding, each actuator column actually includes 40 actuators for recording information with a resolution of 600 dpi.

While the right-side actuator columns and the left-side actuator columns are slightly shifted from each other in the secondary scanning direction Y, they are arranged generally in axisymmetry, and each include the central actuator column 14A and the first, second and third outer actuator columns 14B, 14C and 14D. Input terminals 37 of the actuators 14 to be described later are arranged locally between the right-side actuator columns and the left-side actuator columns (strictly speaking, between the left-side and right-side central actuator columns 14A and 14A). The input terminals 37 of the actuators 14 form 4 columns of input terminals each extending along a straight line in the secondary scanning direction Y. The specific arrangement pattern of the actuators 14 and the input terminals 37 will be described later.

Data input terminals 51 and 51 to be connected to driving signal lines (not shown) extending from the printer body are provided in a lower left area of the head body 11 in FIG. 4. On the other hand, power supply terminals 53 and 53 are provided in a lower right area of the head body 11, and connection terminals 52 and 54 are provided in a lower central area of the head body 11. The data input terminals 51 and the connection terminals 52 are connected to each other via signal lines 55. The power supply lines 53 and the connection terminals 54 are connected to each other via signal lines 56.

Figure 5:
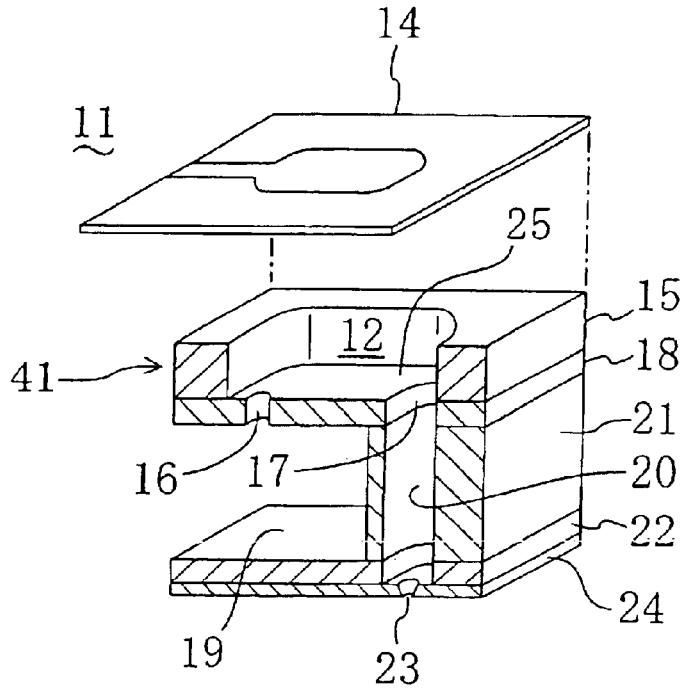
FIG. 5 is a partially exploded perspective view illustrating an important part of an ink jet head.

FIG. 5 is a diagram illustrating a single unit including the pressure chamber 12, the actuator 14, etc. As illustrated in FIG. 5, the head body 11 includes a body part 41 and the actuator 14. The body part 41 includes a first plate 15 in which a through hole for forming a pressure chamber is provided, a second plate 18 in which an ink supply port 16 and an ink discharge port 17 are provided, third and fourth plates 21 and 22 for forming an ink reservoir 19 and an ink discharge channel 20, and a nozzle plate 24 in which an ink discharge aperture 23 is formed. These plates are stacked on one another in this order. Specifically, a pressure chamber depression 25 having the ink supply port 16 and the ink discharge port 17 on the bottom surface thereof is formed by the first plate 15 and the second plate 18, and the ink reservoir 19 connected to the ink supply port 16 and the ink discharge channel 20 connected to the ink discharge port 17 are formed by the second, third and fourth plates 18, 21 and 22, with the ink discharge channel 20 being connected to the nozzle 23 of the nozzle plate 24. The actuator 14 is provided on the first plate 15 so as to cover the opening of the pressure chamber depression 25, thereby forming the pressure chamber 12.

The first plate 15, which is the uppermost plate (the plate closest to the driver IC 13) among the various plates of the body part 41, is made of the same material as the driver IC 13. Specifically, the first plate 15 is made of silicon (Si). Note that the other plates such as the second plate 18 may also be made of a silicon, or the entirety of the body part 41 may be made of silicon.

Figure 6:
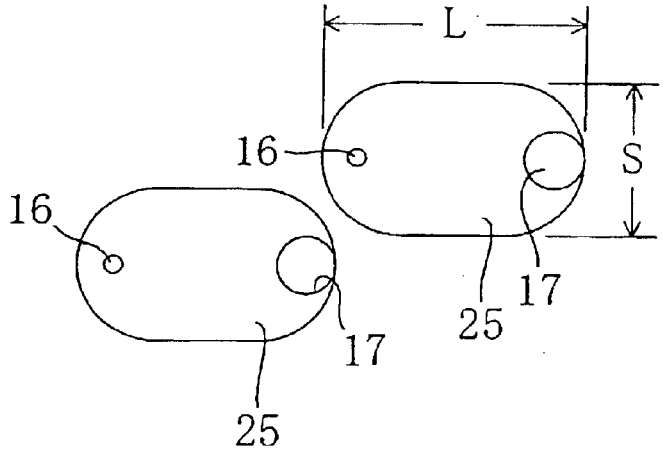
FIG. 6 is a plan view illustrating the shape of an opening of a pressure chamber depression of a head body (which is also the shape of an actuator).

As illustrated in FIG. 6, the shape of the opening of the pressure chamber depression 25 is an oval shape such that the ratio L/S between the longer axis L and the shorter axis S is 1 to 3 and such that the longer axis L is parallel to the primary scanning direction X.

Figure 7:
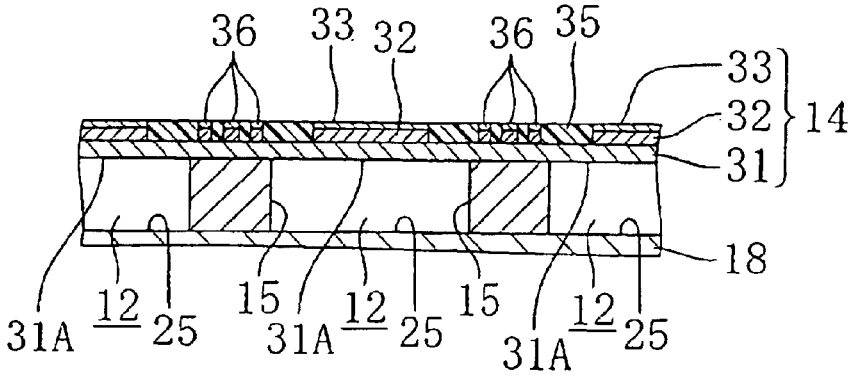
FIG. 7 is a cross-sectional view (taken along line Z—Z of FIG. 8) illustrating a head body.

As illustrated in FIG. 7, each actuator 14 includes a vibration plate 31 provided on the surface of the first plate 15 so as to cover a large number of pressure chamber depressions 25, a piezoelectric element 32 provided on a movable portion 31A of the vibration plate 31 forming one wall surface of each pressure chamber 12, and a separate electrode 33 provided on the piezoelectric element 32. The vibration plate 31 is made of Cr or a Cr-based material and has a thickness of 1 to 5 $\mu$m, and also functions as a common electrode for discharging ink in all the pressure chambers 12. In contrast, the piezoelectric elements 32 and the separate electrodes 33 are individually provided for the respective pressure chambers 12. The piezoelectric element 32 is made of PZT and has a thickness of 1 to 7 $\mu$m. The separate electrode 33 is made of Pt or a Pt-based material and has a thickness of 1 μm or less, e.g., 0.1 μm. The piezoelectric element 32 and the separate electrode 33 above the pressure chamber depression 25 are formed in an oval shape that is one size smaller than the opening of the pressure chamber depression 25. Note that 35 in FIG. 7 is an insulative member for preventing short-circuiting between adjacent separate electrodes 33 and 33 or between the separate electrode 33 and a conductor 36 to be described later. For example, a resin, or the like, may suitably be used as such an insulative member. For ease of illustration, the insulative material 35 is not shown except in FIG. 7.

The piezoelectric elements 32 and the separate electrodes 33 individually provided for the respective pressure chambers 12 are aligned with each other to draw the same pattern on the surface of the vibration plate 31. The piezoelectric element 32 and the separate electrode 33, together with the movable portion 31A of the vibration plate 31, form the actuator 14 for applying an ink discharging pressure to the pressure chamber 12 by deforming the movable portion 31A. Next, a specific arrangement pattern of the actuators 14 will be described with reference to FIG. 8.

Figure 8:
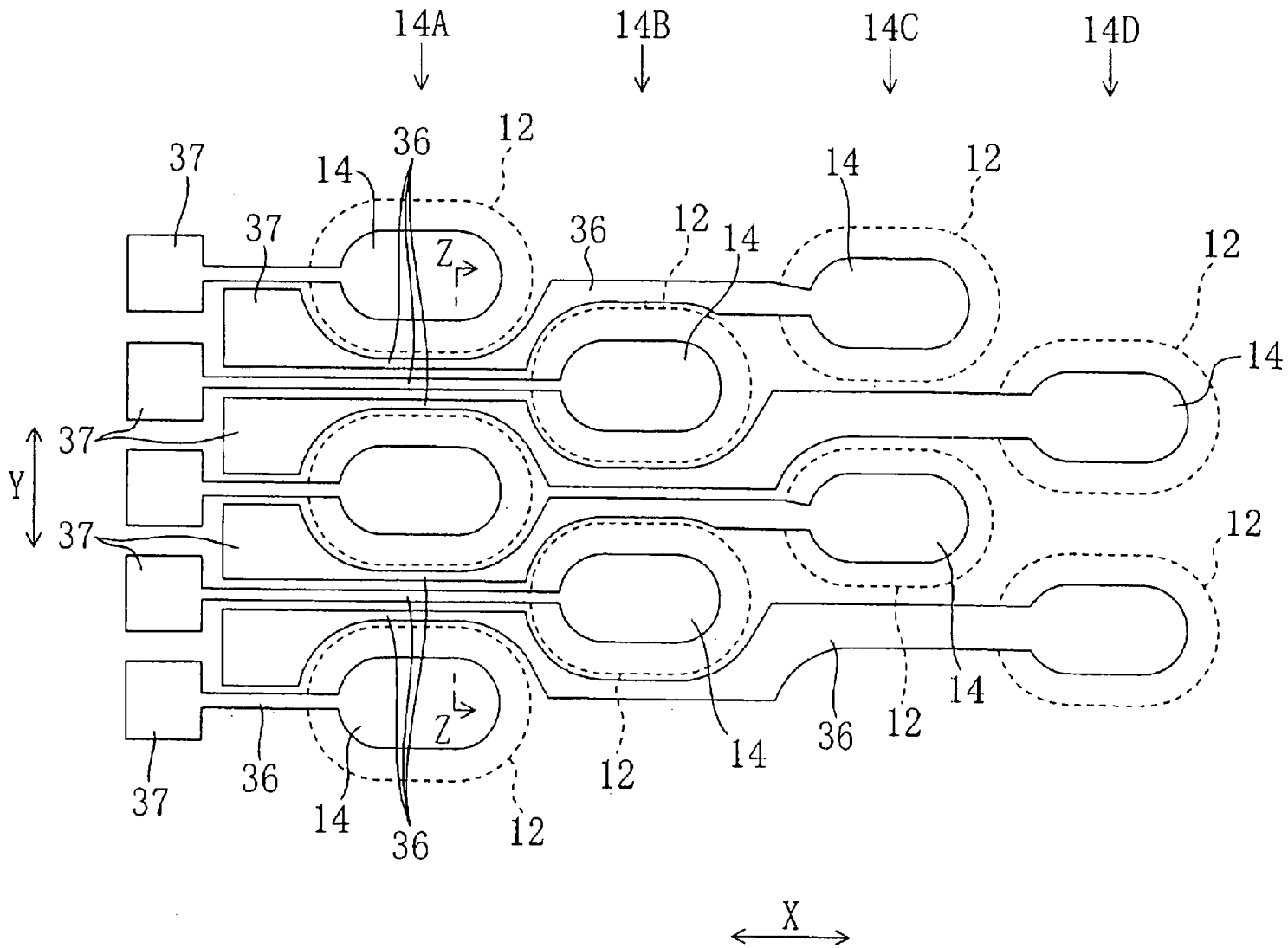
FIG. 8 is a diagram illustrating the surface of a head body, showing an arrangement pattern of actuators and input terminals.

FIG. 8 illustrates the 4 columns on the right side in FIG. 4 among the 8 actuator columns, and each actuator 14 is provided so that the longer axis L is perpendicular to the column direction (the secondary scanning direction Y). The actuators of each of the actuator columns 14A to 14D are shifted, with respect to the secondary scanning direction Y, from the actuators 14 of any other actuator column. Specifically, each actuator 14 of the first outer actuator column 14B is arranged between adjacent actuators 14 and 14 of the central actuator column 14A with respect to the secondary scanning direction Y. The positional relationship between the central actuator column 14A and the first outer actuator column 14B is similar to that between the first outer actuator column 14B and the second outer actuator column 14C, and that of the second outer actuator column 14C and the third outer actuator column 14D. Thus, the large number of actuators 14 are arrayed in a plurality of columns extending in the secondary scanning direction Y and are arranged in a so-called "staggered pattern" such that the actuators of a column are shifted from the actuators of an adjacent column. It should be noted that the actuators 14, 14, . . . , of the actuator columns 14A to 14D are never aligned with one another along the same straight line perpendicular to the secondary scanning direction Y, but are arranged so as to be slightly shifted from one another in the column direction Y. This is for shifting the dot positions from one another in the secondary scanning direction.

Note that the 4 left-side columns shown in FIG. 4 are also arranged in a staggered pattern as are the 4 right-side columns, and also in the 4 left-side columns, the actuators 14 of each actuator column are arranged so as to be slightly shifted in the column direction Y from the actuators 14 in any other actuator column. Moreover, each actuator 14 in the 4 left-side actuator columns is also shifted in the column direction from, and not aligned along the same straight line with, any actuator 14 in the 4 right-side actuator columns. Thus, each actuator 14 in a total of 8 actuator columns is slightly shifted in the column direction from, and not aligned along the same straight line with, any other actuator 14 in any other actuator column, so as to increase the dot density by shifting the dot positions from one another in the secondary scanning direction. Note that the left-side and right-side central actuator columns 14A and 14A correspond respectively to "first central actuator column" and "second central actuator column" as used in the present invention.

The piezoelectric elements 32 and the separate electrodes 33 individually provided for the respective pressure chambers 12 extend in the central portion (the left end portion in FIG. 8) of the head body 11 while being aligned with each other, and the extensions thereof form conductors (signal lines) 36 for transmitting driving signals. Moreover, a tip portion of each conductor 36 forms an input terminal 37 of the actuator 14 having a width larger than that of the conductor 36. The conductor 36 of the actuator 14 of an outer actuator column is arranged to pass between adjacent actuators 14 and 14 of the next inner actuator column.

The input terminals 37 of the actuators 14 of the central actuator column 14A and the first outer actuator column 14B are arranged on the same straight line extending in the secondary scanning direction. Moreover, the input terminals 37 of the actuators 14 of the second outer actuator column 14C and the third outer actuator column 14D are arranged on the same straight line extending in the secondary scanning direction, slightly away in the primary scanning direction from the input terminal column of the actuators 14 of the central actuator column 14A and the first outer actuator column 14B. Thus, the input terminals 37 of the actuators 14 of the actuator columns 14A to 14D form two input terminal columns extending in the secondary scanning direction Y. Note that the arrangement of the input terminals 37 as described above is similar for the 4 left-side columns, whereby 4 input terminal columns are formed for the entire head.

As described above, in the ink jet head 1, the large number of actuators 14 are arranged in a plurality of columns and in a staggered pattern so as to maximize the density thereof. Moreover, each space between adjacent actuators 14 and 14 of each actuator column is used as a space for providing the conductor 36 of an actuator 14 of another actuator column. For example, since three actuator columns 14B, 14C and 14D are provided on the outer side of the central actuator column 14A, three conductors 36 pass between adjacent actuators 14 and 14 of the central actuator column 14A (see FIG. 7).

Figure 9:
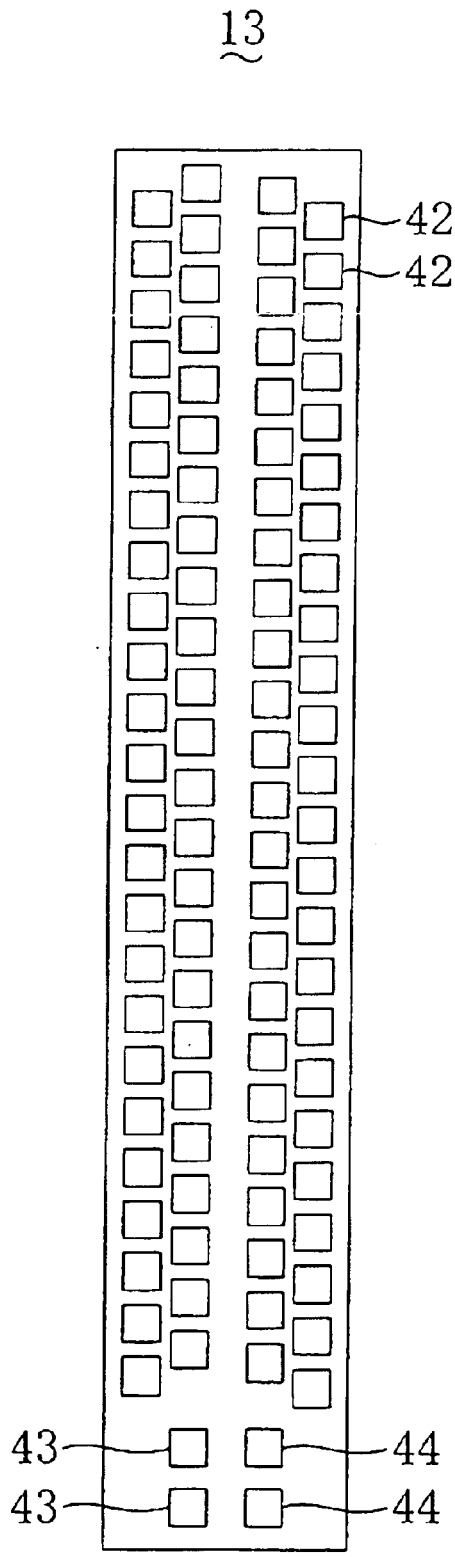
FIG. 9 is a plan view illustrating a driver IC, showing an arrangement pattern of output terminals.

As illustrated in FIG. 9, a plurality of output terminals 42 are arranged on the counter surface of the driver IC 13 so as to respectively correspond to the input terminals 37 of the actuators 14 of the head body 11. Specifically, the driver IC 13 is provided with 4 output terminal columns extending in the secondary scanning direction so as to respectively correspond to the 4 input terminal columns of the head body 11. Note that while FIG. 9 show a reduced number of output terminals 42 again for ease of understanding, 320 output terminals 42 are actually provided. Connection terminals 43 and 44 are provided on the lower end portion of the counter surface of the driver IC so as to respectively correspond to the connection terminals 52 and 54 of the head body 11.

Figure 10:
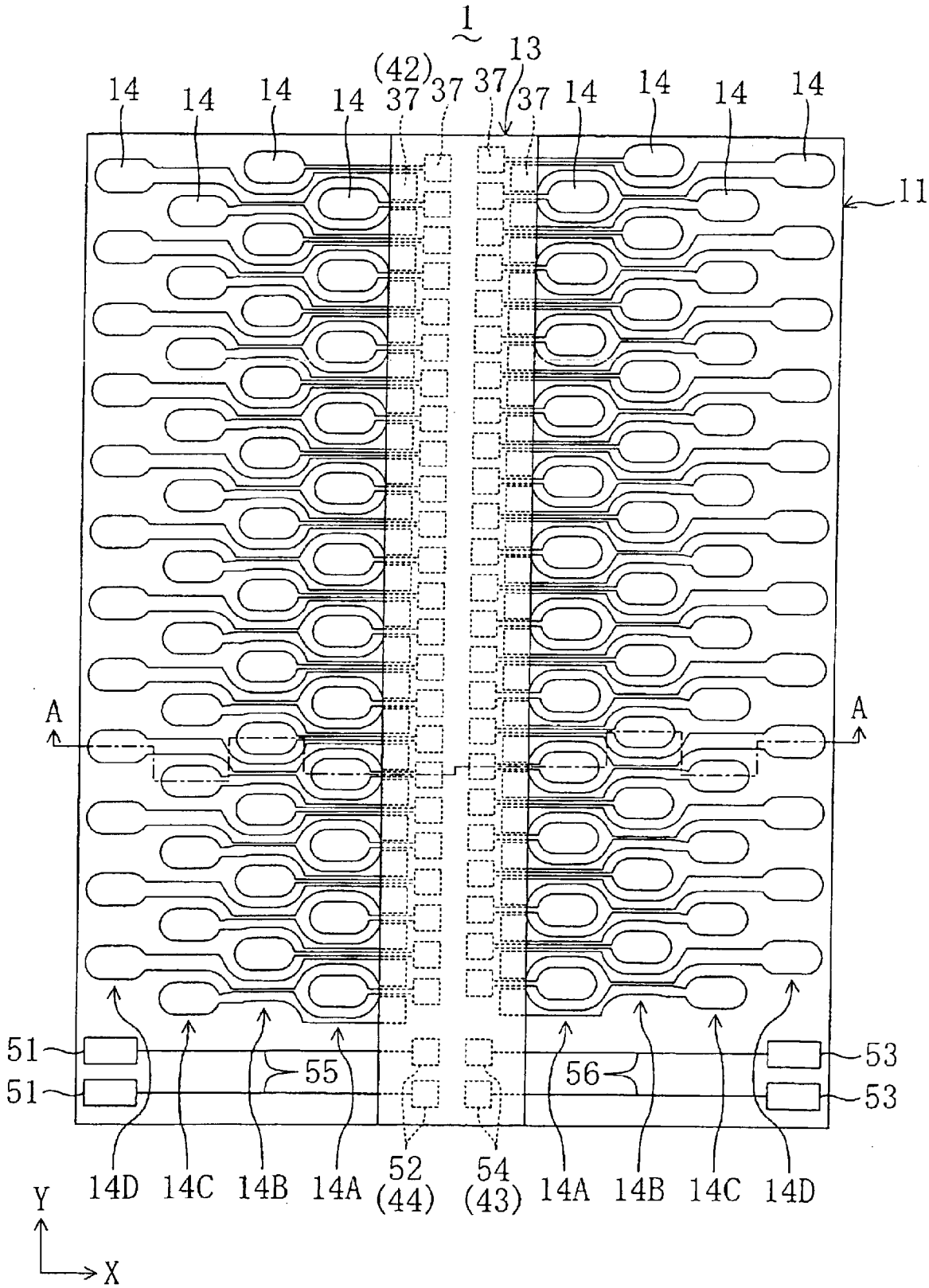
FIG. 10 is a diagram illustrating the surface of an ink jet head with a driver IC being mounted thereon.

The driver IC 13 is mounted on the head body 11 by flip chip bonding so that the output terminals 42 and the input terminals 37 respectively contact each other, the connection terminals 52 and the connection terminals 44 respectively contact each other, and the connection terminals 54 and the connection terminals 43 respective contact each other, as illustrated in FIG. 3 and FIG. 10.

Method for Producing Ink Jet Head

Figure 11:
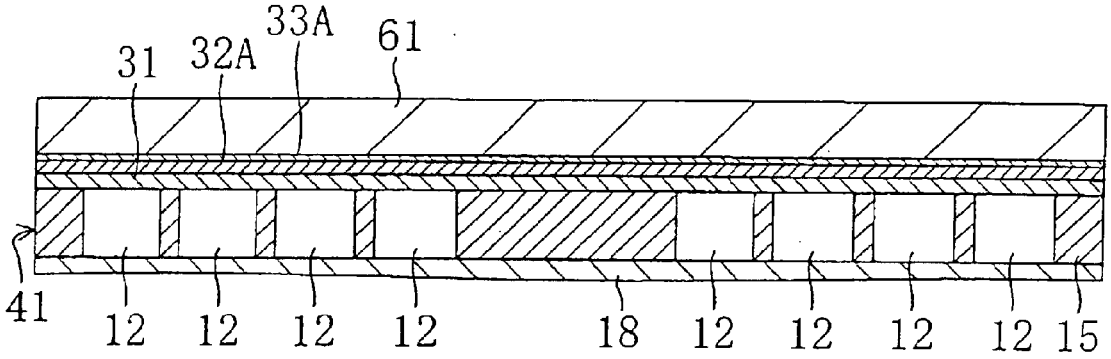
FIG. 11 is a diagram illustrating a step in the production of an ink jet head.

Next, a method for producing an ink jet head 1 will be described. First, as illustrated in FIG. 11, a platinum (Pt) layer 33A, a PZT layer 32A and the vibration plate 31 made of Cr are deposited in this order on a surface of a substrate 61 made of magnesium oxide (MgO) by sputtering, or the like, and then bonded to the body part 41 by using an adhesive such as an epoxy resin so that the vibration plate 31 faces the pressure chamber depressions 25. Note that the body part 41 is formed in advance by bonding the first plate 15, the second plate 18, the third plate 21, the fourth plate 22 and the nozzle plate 24 on one another in this order by using an adhesive such as an epoxy resin. Each plate such as the first plate 15 is formed by providing a through hole, or the like, in a silicon substrate by etching such as anisotropic etching. Note that means for securing the vibration plate 31 and the body part 41 to each other, and means for securing the plates of the body part 41 to one another, are not limited to an adhesive as described above.

Figure 12:
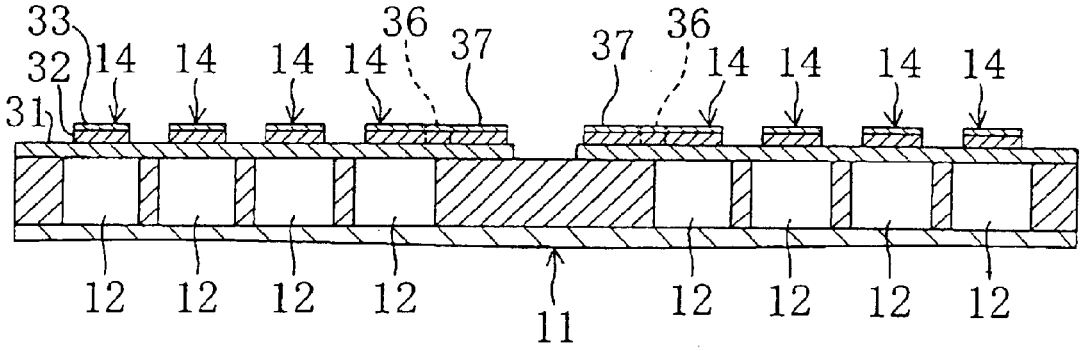
FIG. 12 is a diagram illustrating a step in the production of an ink jet head.

Then, as illustrated in FIG. 12, the substrate 61 is removed, and then the platinum layer 33A and the PZT layer 32A are patterned by etching, or the like, so as to form a plurality of actuators 14 respectively corresponding to the pressure chambers 12, the conductors 36 and the input terminals 37. Then, a portion of the vibration plate 31 between the central input terminal columns is removed. Thus, the head body 11 is formed.

Then, solder bumps are formed on the input terminals 37 of the head body 11 or on the output terminals 42 of the driver IC 13, for example, and the driver IC 13 is connected to the head body 11 by flip chip bonding, thus obtaining the ink jet head 1.

In the flip chip bonding process, heat is applied for melting the solder. Therefore, the head body 11 and the driver IC 13 thermally expand due to the heating, and then thermally contract along with the subsequent decrease in temperature. Nevertheless, in the ink jet head 1 of the present embodiment, at least the first plate 15, which is located on the uppermost side of the body part 41 of the head body 11, is made of the same material (silicon) as the driver IC 13, whereby the degree of thermal expansion and thermal contraction of the input terminals 37 is substantially the same as that of the output terminals 42. As a result, there is substantially no positional shift between the input terminals 37 and the output terminals 42 due to thermal expansion and/or thermal contraction. Therefore, while the head is downsized, the output terminals 42 do not peel off from the input terminals 37, and a desirable contact between the input terminals 37 and the output terminals 42 is maintained. Similarly a desirable contact is achieved between the connection terminals 44 and 52 and between the connection terminals 43 and 54. As a result, according to the present embodiment, the reliability is improved and the yield is increased.

Moreover, a residual stress does not occur between the head body 11 and the driver IC, and the head body 11 does not undergo an extra compression shear force or tensile shear force from the driver IC. Therefore, the ink discharging performance does not deteriorate.

Note that while only the first plate 15 may be made of the same material as the driver IC 13, one or more or all of the second, third and fourth plates 18, 21 and 22, or the entirety of the body part 41, may be made of the same material as the driver IC 13. Thus, the thermal deformation followability of the input terminals 37 with respect to the output terminals 42 is further improved, and the connection between the input terminals 37 and the output terminals 42 can be maintained at an even higher level.

As described above, according to the present embodiment, the input terminals 37 are arranged locally between the left-side actuator columns 14A to 14D and the right-side actuator columns 14A to 14D, and the driver IC 13 is mounted on the head body 11 by face down bonding, whereby it is not necessary to provide a space for providing input terminals in an area remote from the actuators. Moreover, each space between adjacent actuators 14 and 14 of an actuator column is efficiently used as a space for providing the conductors 36, whereby it is not necessary to provide a space for providing conductors in an area remote from the actuators. Therefore, the head can be downsized over the prior art.

Variation

Figure 13:
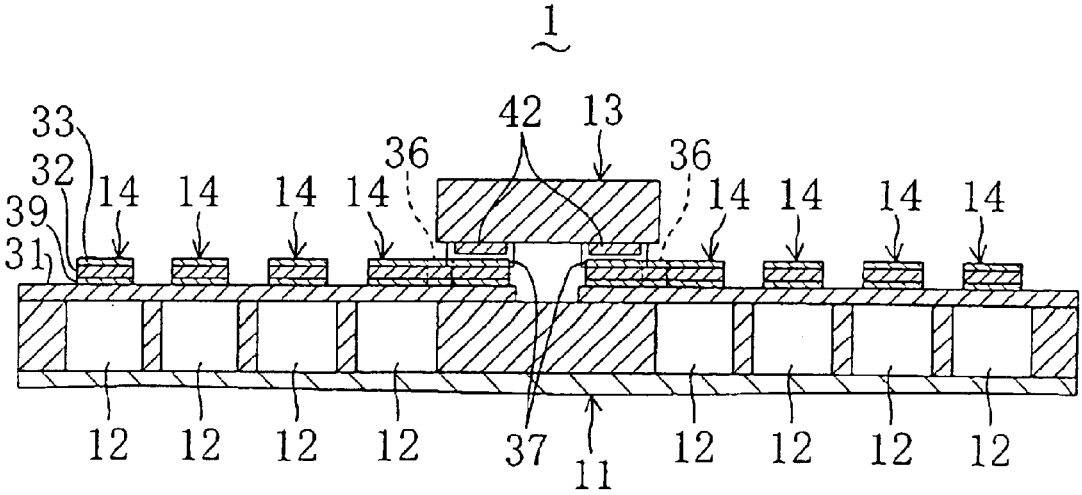
FIG. 13 is a cross-sectional view illustrating an ink jet head.

As illustrated in FIG. 13, the vibration plate 31 may be made of the same material as the driver IC 13. Specifically, the vibration plate 31 may be made of silicon. In this variation, common electrodes 39, the piezoelectric elements 32 and the separate electrodes 33 are deposited in this order on the vibration plate 31. In this variation, with such a configuration, each actuator 14 is formed by the movable portion of the vibration plate 31, the common electrode 39, the piezoelectric element 32 and the separate electrode 33. Note that the common electrode 39 and the separate electrode 33 are made of platinum, and the piezoelectric element 32 is made of PZT. The thickness of the vibration plate 31 is preferably about 3 to 6 $\mu$m, and more preferably 4 to 5 $\mu$m.

In this variation, the vibration plate 31, on which the input terminals 37 are placed (in other words, the vibration plate 31, which supports the input terminals 37), itself is made of the same material as the driver IC 13, whereby the degree of thermal deformation of the vibration plate 31 matches with that of the driver IC 13, and the amount of relative displacement between the input terminals 37 and the output terminals 42 becomes extremely small. Therefore, the connection between the input terminals 37 and the output terminals 42 is maintained even more desirably. Thus, the head can be downsized without being restricted by the problem of the connection between terminals.

<Embodiment 2>

Figure 14:
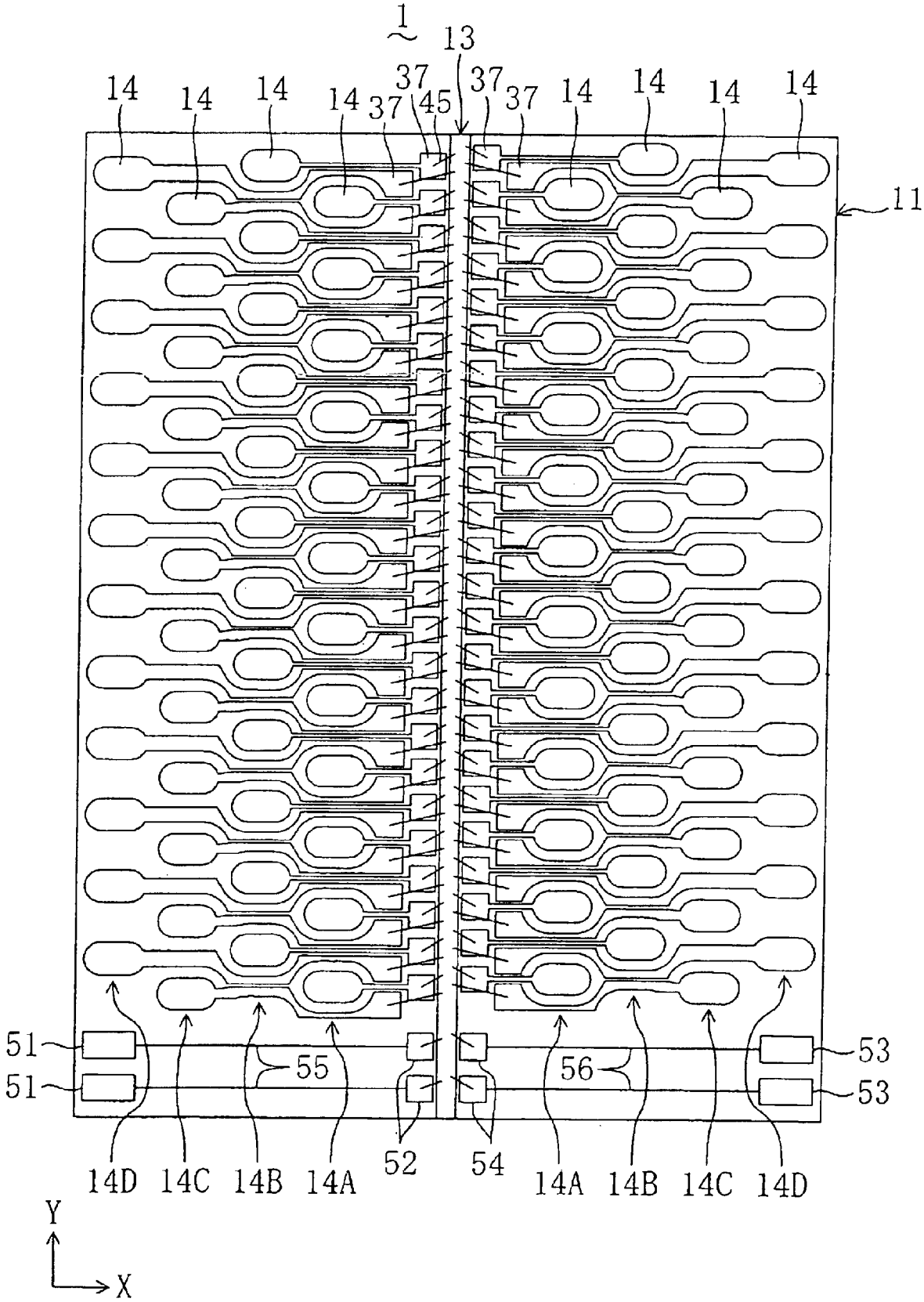
FIG. 14 is a diagram illustrating the surface of an ink jet head.

As illustrated in FIG. 14, in the ink jet head 1 according to Embodiment 2, the driver IC 13 is mounted by a face up method, and the terminals of the driver IC 13 and the terminals of the head body 11 are connected together by wire bonding.

In the present embodiment, the driver IC 13 is attached between the terminals 37 of the right-side actuator columns and the terminals 37 of the left-side actuator columns of the head body 11. In the attachment process, the entire reverse surface of the driver IC 13 may be attached to the head body 11, or may be attached in a dotted matter at two or more positions on the reverse surface. As in Embodiment 1, the driver IC 13 is made of silicon, and at least the first plate 15 of the head body 11 is made of silicon. Note that the configuration of the head body 11 is as that of Embodiment 1.

Although not shown, the output terminals of the driver IC 13 are provided on the front surface side of the driver IC 13. The output terminals of the driver IC 13 and the input terminals 37 of the head body 11 are connected together via wires 45. Moreover, the connection terminals 52 for data input and the connection terminals 54 for power supply are also connected to the connection terminals of the driver IC 13 via the wires 45.

<Embodiment 3>

Figure 15:
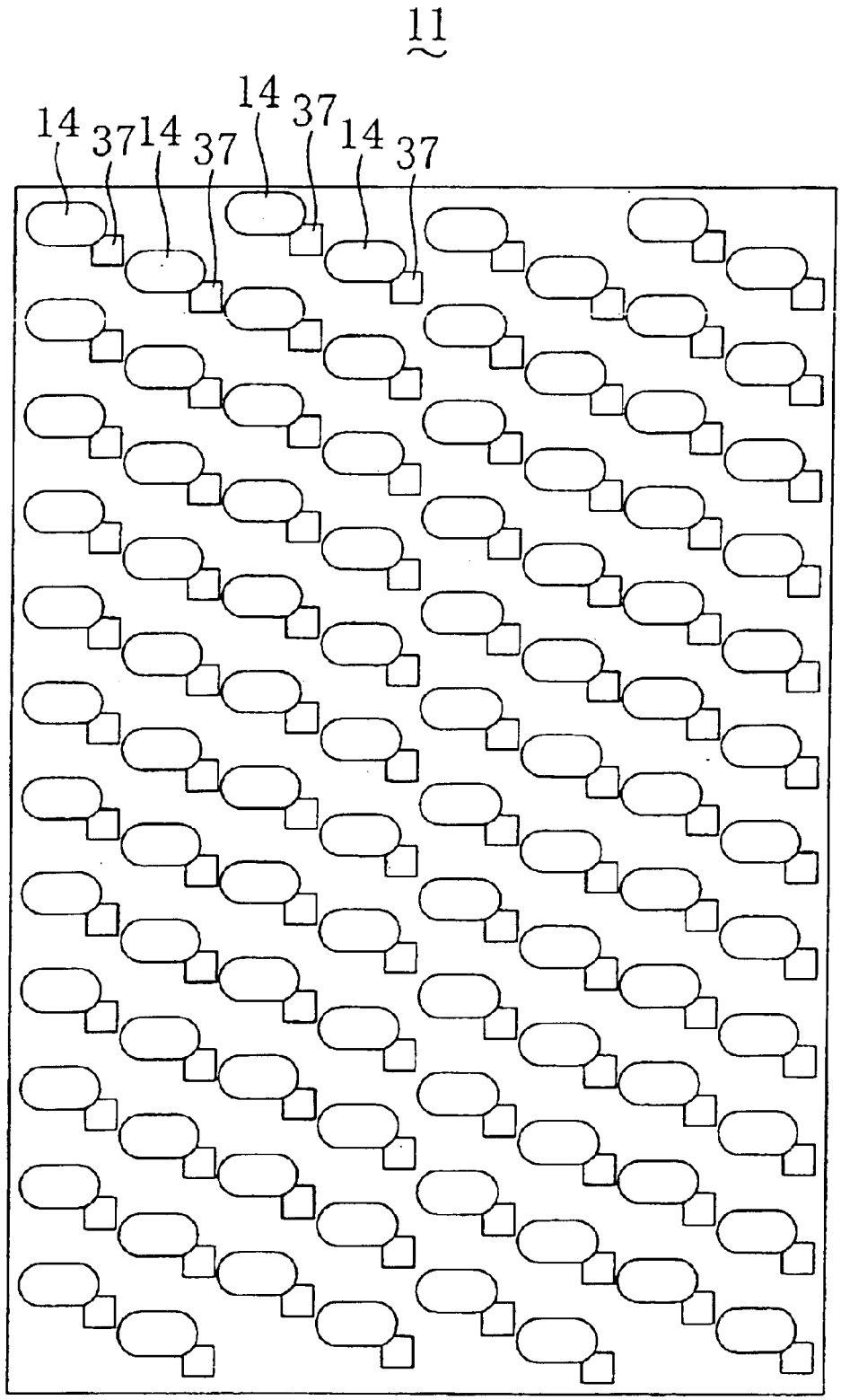
FIG. 15 is a diagram illustrating the surface of a head body of an ink jet head.

As the density of the head increases, it is more difficult to provide the conductor 36 of an actuator 14 between other actuators 14 and 14. In view of this, in the ink jet head of Embodiment 3, the arrangement pattern of the actuators 14 and the input terminals 37 is changed so that the conductors 36 are eliminated, as illustrated in FIG. 15.

Specifically, in the present embodiment, as in Embodiment 1, 8 actuator columns are formed, and an actuator in any actuator column is arranged so as to be shifted in the column direction Y from any other actuator of any other actuator column. Moreover, in the present embodiment, the input terminal 37 of each actuator is arranged near the actuator 14 so as to be continuous with the actuator 14. With such an arrangement, the input terminal 37 is connected directly to the actuator 14, thus eliminating the conductors 36.

Figure 16:
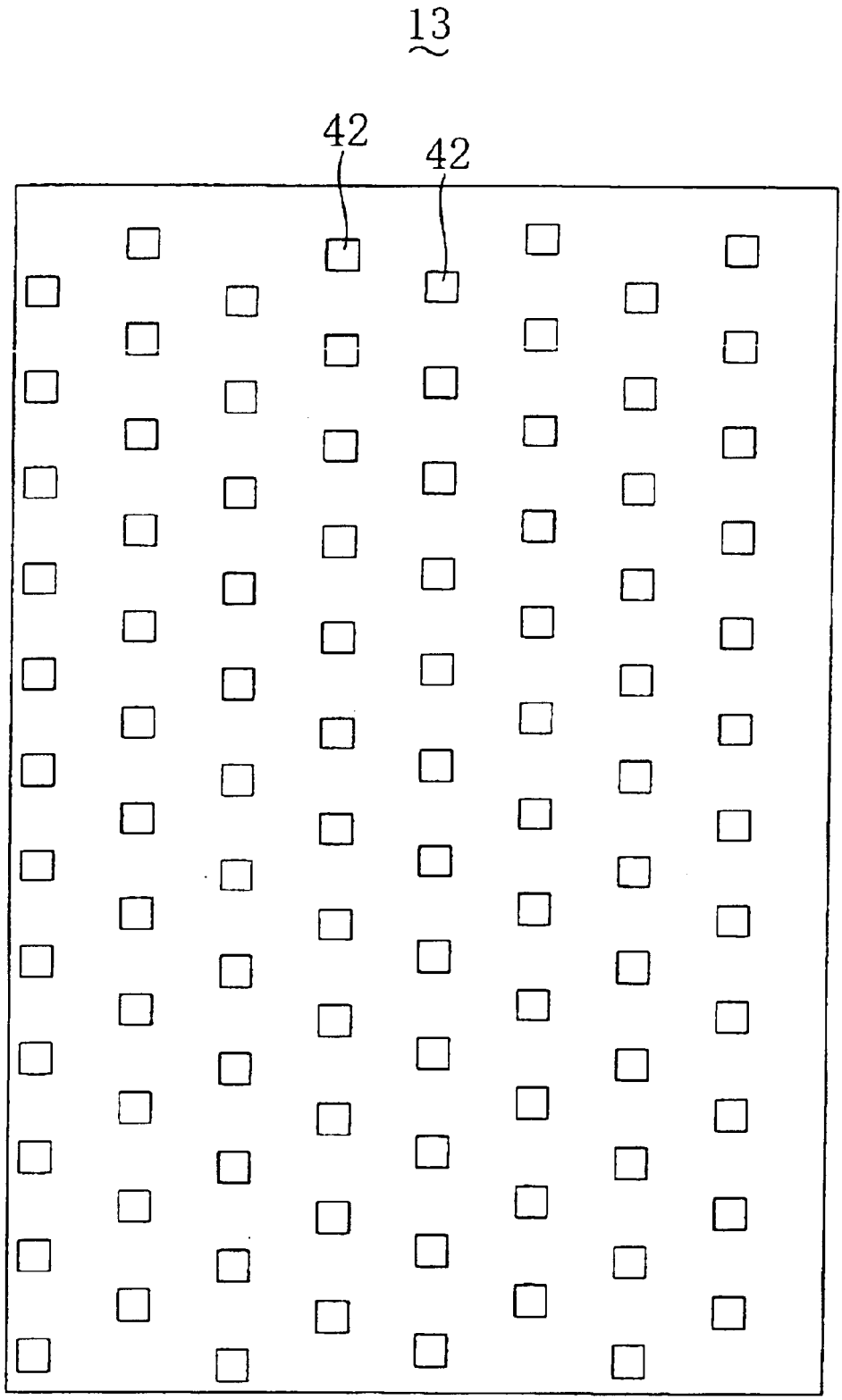
FIG. 16 is a plan view illustrating an arrangement pattern of output terminals of a driver IC.

As illustrated in FIG. 16, the output terminals 42 are arranged on the counter surface of the driver IC 13 in a pattern symmetrical to the arrangement pattern of the input terminals 37 of the actuators 14. The driver IC 13 is mounted on the head body 11 by flip chip bonding as in Embodiment 1.

Therefore, according to the present embodiment, it is not necessary to provide the space for providing the conductors 36, and thus it is possible to further downsize the head without being restricted by the conductors 36, in addition to the effects obtained in Embodiment 1. As a result, the density of the head can be further increased. As the density of the head is increased, the effect of the present invention of maintaining a desirable connection between the input terminals 37 and the output terminals 42 is even more pronounced.

<Embodiment 4>

In the preceding embodiments, at least the front surface side portion, or the entirety, of the body part 41 of the head body 11 is made of the same material as the driver IC 13. Alternatively, such a portion or the entirety of the body part 41 may be made of a material whose coefficient of linear expansion is substantially equal to that of the driver IC 13. Moreover, the vibration plate 31 may be made of a material whose coefficient of linear expansion is substantially equal to that of the driver IC 13. Also with such a configuration, it is possible to prevent contact failure between terminals and deterioration of the discharging performance due to thermal deformation.

<Embodiment 5>

The present embodiment aims to suppress flexural deformation of the head body 11 due to a difference between the coefficient of linear expansion of the head body 11 and that of the driver IC 13.

Figure 17A:
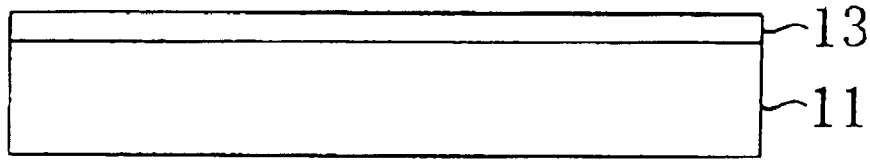
FIG. 17(*a*) to FIG. 17(*c*) are diagrams illustrating flexural deformation of an ink jet head due to a residual stress.
Figure 17B:
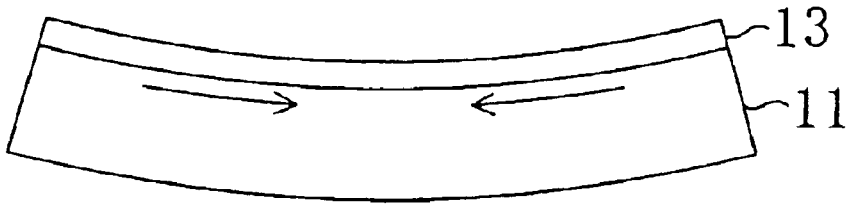
Figure 17C:
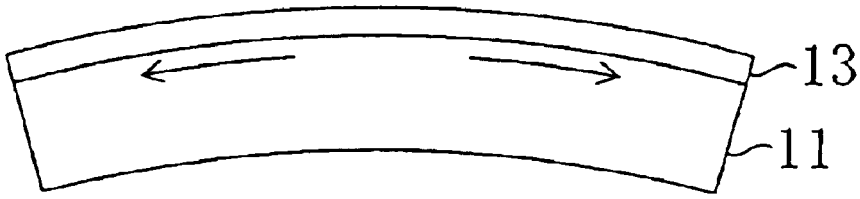

In a case where the head body 11 is more likely to thermally expand than the driver IC 13, or in a case where the head body 11 is less likely to thermally contract than the driver IC 13, the head body 11 undergoes a compression shear force from the driver IC 13 so as to bend into a concave shape as illustrated in FIG. 17(*b*). When the compression shear force on the head body 11 is excessive, the ink discharging directions of the nozzles at both ends of the head body 11 are inclined. Therefore, the striking positions of ink droplets discharged from the nozzles at both ends of the head body 11 are likely to be shifted from the intended positions. Moreover, the actuators of the head body 11 become more flexible due to the compression shear force acting thereon. Thus, the rigidity thereof decreases. As a result, the amount of ink to be discharged increases, whereby a tendency of ink dots to be larger is observed. Moreover, the resonance frequency decreases, whereby the driving frequency decreases, and the printing speed is likely to decrease.

On the other hand, in a case where the head body 11 is less likely to thermally expand than the driver IC 13, or in a case where the head body 11 is more likely to thermally contract than the driver IC 13, the head body 11 undergoes a tensile shear force from the driver IC 13 so as to bend into a convex shape as illustrated in FIG. 17(*c*). When the tensile shear force on the actuator is excessive, the ink discharging directions of the nozzles at both ends of the head body 11 are inclined, as in the case where it undergoes an excessive compression shear force. Therefore, also in such a case, the striking positions of ink droplets discharged from the nozzles at both ends of the head body 11 are likely to be shifted from the intended positions. Moreover, the actuators of the head body 11 become less flexible due to the tensile shear force acting thereon. Thus, the rigidity thereof increases. Therefore, the amount of ink to be discharged is likely to decrease, thereby reducing the size of ink dots and thus blurring the characters. If the tensile shear force acting on the actuators is considerably large, it is possible that no ink at all is discharged from the nozzles at both ends of the head body 11. However, when an actuator undergoes a tensile shear force, the resonance frequency increases, whereby the driving frequency increases. Therefore, it may provide favorable effects in terms of the printing speed if the tensile shear force is not excessive.

In contrast, in a case where the amount of thermal deformation of the driver IC 13 is about the same as that of the head body 11, no extra stress is exerted, whereby the head body 11 will not bend, as illustrated in FIG. 17(*a*).

The amount of thermal deformation of the driver IC 13 and the head body 11 is larger as the temperature difference between the environmental temperature during the process of attaching them to each other (hereinafter referred to as the "environmental temperature at attachment") and the operating temperature of the ink jet head is larger. Moreover, it is larger as the difference between the coefficient of linear expansion of the driver IC 13 and that of the head body 11 is larger. Embodiment 4 provides a modification for reducing the difference in coefficient of linear expansion. In contrast, the present embodiment aims to suppress the flexural deformation of the head body 11 by reducing the temperature difference between the environmental temperature at attachment and the operating temperature.

Specifically, in the present embodiment, the attachment of the driver IC 13 and the head body 11 to each other is done under an environment at an intermediate temperature substantially in the middle of the guaranteed operating temperature range of the ink jet head. For example, when the guaranteed operating temperature range is 5 to 45° C., the attachment is done under a temperature environment at 25° C. or around 25° C.

In this way, even if the operating temperature of the ink jet head changes, the temperature difference between the environmental temperature at attachment and the operating temperature remains to be relatively small, whereby it is possible to suppress the amount of thermal deformation of the head body 11 and the driver IC 13 to be small. Therefore, the flexural deformation of the head body 11 is suppressed, and the ink discharging performance can be desirably maintained. In other words, it is possible to stably provide a predetermined level of ink discharging performance.

Note that while the guaranteed operating temperature range is assumed to be 5 to 45° C. in the present embodiment, the guaranteed operating temperature range varies depending on the specification of the ink jet head, etc. Therefore, the intermediate temperature of the guaranteed operating temperature range is not limited to 25° C. Generally, effects as described above can be obtained by setting the environmental temperature at attachment to be 15 to 30° C.

<Embodiment 6>

When the difference between the coefficient of linear expansion of the driver IC 13 and that of the head body 11 is relatively large, there are cases where the flexural deformation of the head body 11 is unavoidable even if the difference between the environmental temperature at attachment and the operating temperature is small. As described above, when the head body 11 bends into a convex shape, the amount of ink to be discharged is likely to be insufficient, whereby the recording area in a so-called "solid image" may not be painted completely. In contrast, when the head body 11 bends into a concave shape, the amount of ink to be discharged is likely to be excessive, but blurring of characters or incomplete painting of a recording area will not occur. In other words, the print itself will not be incomplete. In view of this, in the present embodiment, the environmental temperature at attachment is set so that the head body 11 bends into a concave shape, whereby at least the printing operation itself can be performed even if the operating temperature changes.

Specifically, in a case where the coefficient of linear expansion of the head body 11 is larger than that of the driver IC 13, the environmental temperature at attachment is set to be the lowest temperature within the guaranteed operating temperature range. For example, when the guaranteed operating temperature range is 5 to 45° C., the environmental temperature at attachment is set to be 5° C. In this way, the head body 11 is always under a compression shear force from the driver IC 13, whereby the actuators will also be under the compression shear force. As a result, the rigidity of the actuators decreases, and the actuators become more flexible. Therefore, the amount of discharge will not decrease, whereby it is possible to prevent the print itself from being incomplete.

On the other hand, in a case where the coefficient of linear expansion of the head body 11 is smaller than that of the driver IC 13, the environmental temperature at attachment is set to be the highest temperature within the guaranteed operating temperature range. For example, when the guaranteed operating temperature range is 5 to 45° C., the environmental temperature at attachment is set to be 45° C. Also in this case, the head body 11 is always under a compression shear force from the driver IC 13, and the rigidity of the actuators decreases. Therefore, it is possible to prevent the print itself from being incomplete.

Note that the values of the lowest temperature and the highest temperature are merely exemplary, and the environmental temperature at attachment is not limited to the values above. The environmental temperature at attachment may suitably be set according to the specific value of the guaranteed operating temperature range. For example, the environmental temperature at attachment in a case where the coefficient of linear expansion of the head body 11 is larger than that of the driver IC 13 may be 0 to 10° C. Moreover, the environmental temperature at attachment in a case where the coefficient of linear expansion of the head body 11 is smaller than that of the driver IC 13 may be 40 to 50° C. Also with these temperatures, it is possible to obtain effects substantially as those obtained in the preceding embodiments.

Evaluation Test

An evaluation test was conducted for the relationship between the difference Δk between the coefficient of linear expansion of the head body 11 and that of the driver IC 13 and the printing performance by using an ink jet head having the configuration of Embodiment 1. In this test, silicon was used as the material of the driver IC 13. On the other hand, silicon, photosensitive glass, SUS304, polyphenylether and polyorefin were used for the first to fourth plates 15, 18, 21 and 22 of the head body 11.

Note that in the samples used in this test, the coefficient of linear expansion of the head body 11 is larger than that of the driver IC 13, whereby the head body 11 bends into a concave shape when the operating temperature is on the high temperature side in the guaranteed operating temperature range (i.e., 25 to 45° C.). Therefore, it is considered that there is less deterioration in printing performance as compared to the lower temperature side in the temperature range (i.e., 5 to 25° C.) for which the head body 11 bends into a convex shape. In view of this, it was evaluated whether a desirable solid image can be formed under the most stringent operating condition, i.e., when the operating temperature is equal to the lowest temperature (5° C.) within the guaranteed operating temperature range.

In the test, the amount of ink to be discharged was set to be 15 pl. First, a solid image was printed within a 20 mm×20 mm frame at an operating temperature of 25° C. (room temperature) to confirm that the inside of the frame can be painted completely. Then, the operating temperature was changed to 5° C. to evaluate whether the inside of the frame can still be painted completely. The evaluation results are shown in Table 1.

TABLE 1

| Material of driver IC | Coefficient of linear expansion of driver IC [$\times 10^{-7}$ 1/° C.] | Material of head body | Coefficient of linear expansion of head body [$\times 10^{-7}$ 1/° C.] | Difference Δk in coefficient of linear expansion between head body and driver IC [$\times 10^{-7}$ 1/° C.] | Solid Image evaluation |
|---|---|---|---|---|---|
| Si | 25 | Si | 25 | 0 | ○ |
| Si | 25 | Photosensitive glass | 59 | 34 | ○ |
| Si | 25 | SUS304 | 148 | 123 | ○ |
| Si | 25 | Polyphenylether | 500 | 475 | Δ |
| Si | 25 | Polyorefin | 700 | 675 | X |

It was confirmed from the above test results that a desirable solid image can be formed when the difference Δk between the coefficient of linear expansion of the head body 11 and that of the driver IC 13 is at least $123\times10^{-7}$[1/° C.] or less.

<Embodiment 7>

While the preceding embodiments are directed to a so-called "serial type" ink jet head, the present invention is not limited to the serial type ink jet head, but may alternatively be a so-called "line-type" ink jet head.

Figure 18:
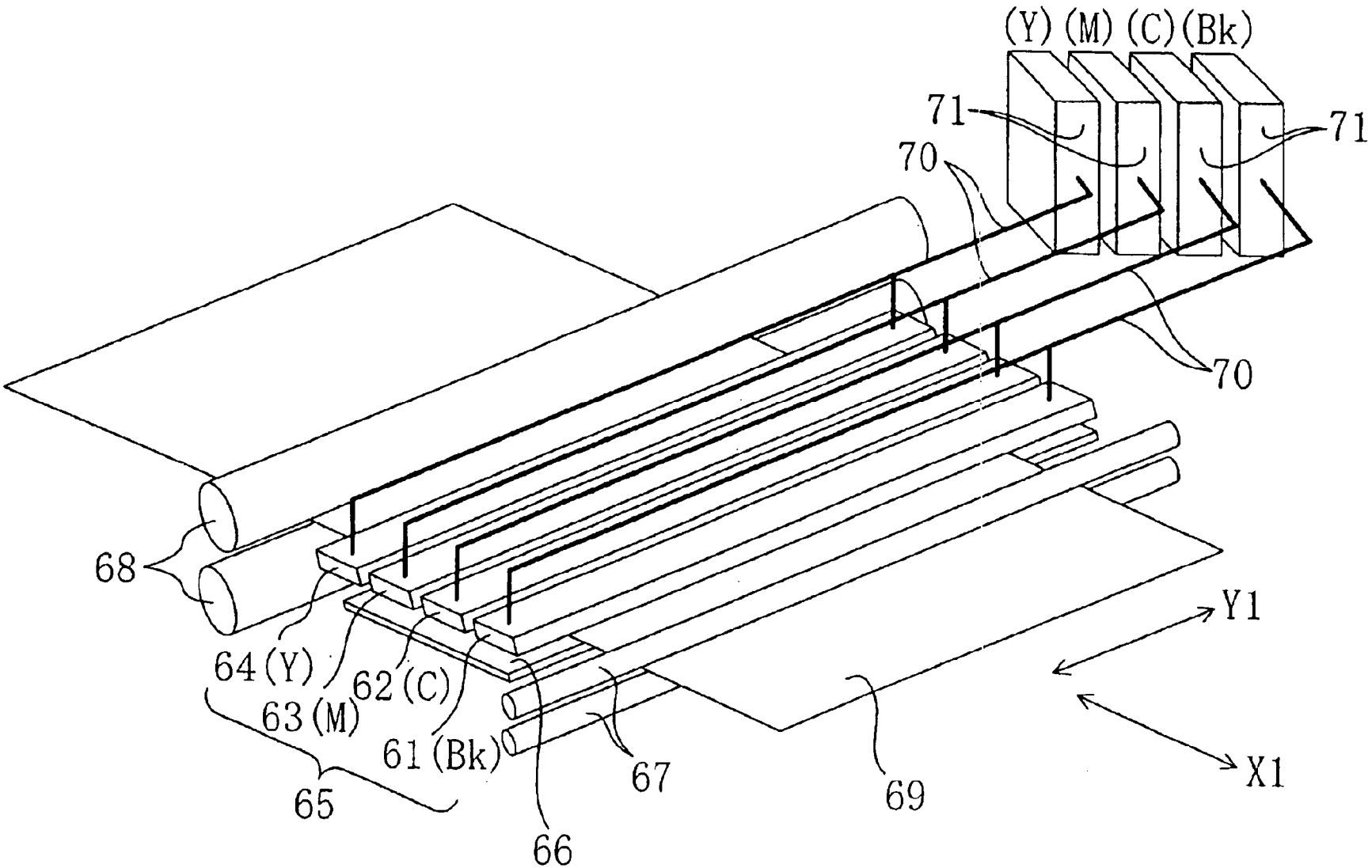
FIG. 18 is a perspective view illustrating an important part of an ink jet printer.
Figure 19:
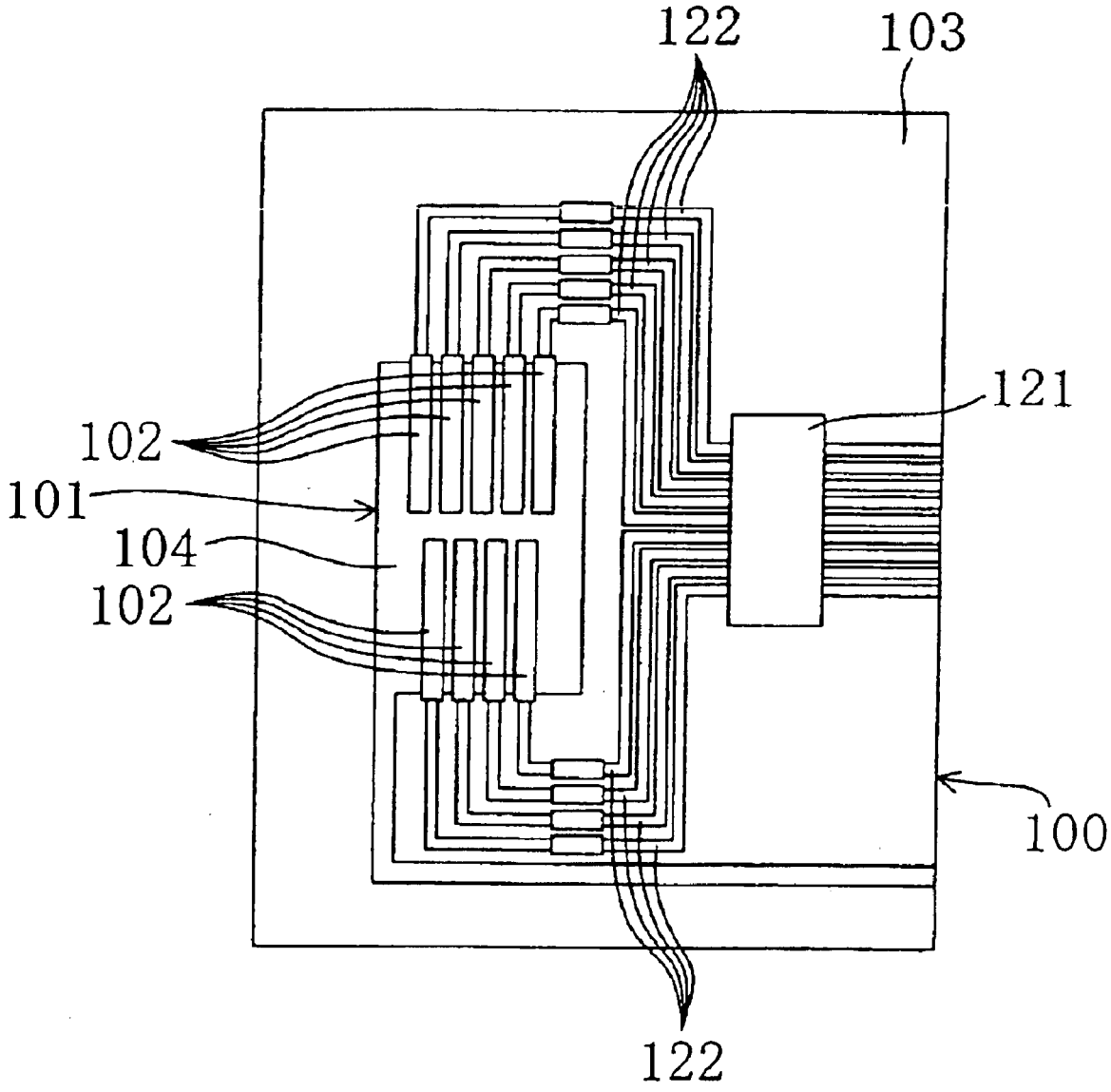
FIG. 19 is a plan view illustrating a conventional way of mounting a driver IC on an ink jet head.

For example, it is possible to apply the present invention to an ink jet head having independent line heads for four colors, as illustrated in FIG. 18. In FIG. 18, 61 is a first line head for discharging a black ink (Bk), 62 is a second line head for discharging a cyan ink (C), 63 is a third line head for discharging a magenta ink (M), and 64 is a fourth line head for discharging a yellow ink (Y). A line head 65 of the present embodiment is obtained by assembling together the first to fourth line heads 61 to 64 so that the black, cyan, magenta and yellow inks are discharged in this order. The inks are respectively supplied to the line heads 61 to 64 through ink tubes 70 connected to ink tanks 71.

A recording medium 69 such as paper is carried by carrier rollers 68 in a carry direction X1 perpendicular to a head width direction Y1. A recording medium holding member 66 for holding the recording medium 69 is provided below the line head 65. The recording medium 69 makes a flat surface on the recording medium holding member 66 as it is placed under a tension by the carrier rollers 68 and feeding rollers 67.

Although not shown, in the line heads 61 to 64, the terminals of the driver IC and the terminals of the head body are connected to each other by flip chip bonding or wire bonding. Moreover, at least the driver IC side portion of the head body is made of the same material as the driver IC or a material whose coefficient of linear expansion is substantially equal to that of the driver IC.

For a line head, since the total length thereof is longer than that of a serial type head, peeling off of terminals due to thermal expansion or thermal contraction is more likely to occur, and the degree of bending of the head body is greater, whereby the ink discharging performance is more likely to deteriorate. Therefore, the effect of the present invention of preventing peeling off of terminals and deterioration of the discharging performance is particularly pronounced.

Industrial Applicability

As described above, the present invention is useful in a recording apparatus, etc., which performs an ink jet type recording operation, such as a printer, a facsimile, and a copier.

What is claimed is:

1. An ink jet head, comprising a head body which is provided with a plurality of nozzles and a plurality of pressure chambers and actuators respectively corresponding to the nozzles, and a driver IC for outputting driving signals for driving the actuators, wherein:

the actuators are arranged on a surface of the head body in a plurality of columns so as to form a plurality of actuator columns;

signal input terminals of the actuators are arranged locally in a predetermined area in a central portion of the surface of the head body between inner actuator columns;

the driver IC is provided with signal output terminals arranged so as to respectively correspond to the signal input terminals of the actuators; and the driver IC is mounted on the head body by being directly attached thereto by face down bonding so that the signal output terminals and the signal input terminal are connected to each other, wherein the actuator columns include a first central actuator column and a second central actuator column adjacent to each other in a central portion of the head body with respect to a scanning direction, and one or more outer actuator column provided on an outer side of the central actuator columns with respect to the scanning direction, wherein the actuators of each outer actuator column and the signal input terminals thereof are connected to each other by signal lines passing between actuators of one of the central actuator columns.

2. The ink jet head of claim 1, wherein:

each of the actuator columns extends in a direction perpendicular to a scanning direction; and the signal input terminals of the actuators are arranged in the direction perpendicular to the scanning direction on the surface of the head body in a central portion thereof with respect to the scanning direction.

3. The ink jet head of claim 2, wherein:

the signal input terminals of the actuators are arranged between the central actuator column and the second central actuator column.

4. The ink jet head of claim 3, wherein the actuators of each actuator column are arranged a regular intervals so as to be shifted from the actuators of any other actuator column in a direction perpendicular to the scanning direction.

5. The ink jet head of claim 4, wherein the actuators are arranged in a staggered pattern.

* * * * *

UNITED STATES PATENT AND TRADEMARK OFFICE

CERTIFICATE OF CORRECTION

PATENT NO. : 6,945,632 B2
APPLICATION NO. : 10/019358
DATED : September 20, 2005
INVENTOR(S) : Tetsuroh Nakamura et al.

It is certified that error appears in the above-identified patent and that said Letters Patent is hereby corrected as shown below:

Title Page

Item (22), PCT Filed:

"Mar. 23, 2001" should be --Feb. 23, 2001--

Column 20

Line 40, Claim 3: after "the" third occurrence, insert --first--

Signed and Sealed this

Twenty-first Day of November, 2006

JON W. DUDAS
*Director of the United States Patent and Trademark Office*